US006668601B1

(12) United States Patent
Reddick

(10) Patent No.: US 6,668,601 B1
(45) Date of Patent: Dec. 30, 2003

(54) LOCKING DEVICE

(76) Inventor: Dennis Reddick, 20600 N. Bogie Rd., Edmond, OK (US) 73003

( * ) Notice: Subject to any disclaimer, the term of this patent is extended or adjusted under 35 U.S.C. 154(b) by 0 days.

(21) Appl. No.: 10/047,767

(22) Filed: Jan. 15, 2002

Related U.S. Application Data

(60) Provisional application No. 60/303,852, filed on Jul. 9, 2001.

(51) Int. Cl.[7] ..... E05B 67/38

(52) U.S. Cl. ..... 70/56; 70/129; 70/212; 70/455; 70/DIG. 63; 292/40; 292/42; 292/148

(58) Field of Search ..... 70/54–56, DIG. 63, 70/129, 212, 423–428, 455; 292/40, 42, 148

(56) References Cited

U.S. PATENT DOCUMENTS 3,736,016 A * 5/1973 Garvey et al. ..... 70/56 X
3,833,104 A * 9/1974 Blum ..... 232/15 X
4,113,291 A * 9/1978 Cameron ..... 292/40
4,142,747 A * 3/1979 Beck et al. ..... 292/37
4,387,917 A * 6/1983 Cocker ..... 292/40
4,438,641 A * 3/1984 Levkov ..... 70/95
4,669,767 A * 6/1987 Leto ..... 292/259 R
4,742,701 A * 5/1988 Scavetto ..... 70/121
5,261,258 A * 11/1993 Bunger ..... 70/56
5,509,700 A * 4/1996 Kennedy, Jr. ..... 292/3
5,743,118 A * 4/1998 Anderson ..... 70/56
5,806,351 A * 9/1998 Learnhan ..... 70/56
6,058,745 A * 5/2000 Sanchez ..... 70/56
6,065,314 A * 5/2000 Nicholson ..... 70/212
6,367,292 B1 * 4/2002 Bunger ..... 70/56

* cited by examiner

*Primary Examiner*—Lloyd A. Gall
(74) *Attorney, Agent, or Firm*—R. William Graham

(57) ABSTRACT

A locking device is provided which is configured to mount to a frame having a locking bar receiving surface therein, which includes a housing for an enclosure with a door opening and a door and having a lock for locking the door to the enclosure about the door opening. A first bar is removably disposable within the locking bar receiving surface and when received therein the device is in a locked position and when removed therefrom is in an unlocked position. A second bar is at least partially movably disposed within the enclosure and is in a laterally spaced and parallel relation with respect to the first bar. Another bar interconnects the first bar and the second bar for providing that the bars move parallel to one another to and from the locked position to the unlocked position. Also, a second lock for locking the device to the frame is disposed within the enclosure having limited accessibility when the door is open.

7 Claims, 3 Drawing Sheets

Simplified Diagram showing Action

Section 5-5 showing lock

LOCKING DEVICE

This application claims the benefit of Provisional application Ser. No. 60/303,852, filed Jul. 9, 2001.

BACKGROUND OF THE INVENTION

1. Field of the Invention

The present invention relates to locking devices. More particularly, the invention is directed to a locking device with improved anti-theft aspects.

2. Related Art

Numerous variety of door locks exist. A type of such door locks germane to the present invention have an external lock body and an internal lock body connected on the door body of the door at two opposite sides. A pair of bars mounted inside the door body are connected in such a way to longitudinally retract and extend into an unlocked/locked position. Typically, the bars are protected in some manner to permit restricted actuation of the bars.

The present invention improves upon this type of lock to provide a door lock which provides increased anti-theft protection. Accordingly, the invention is directed to a locking device which is configured to mount to a frame of an entry way having a lock receiving surface therein, which includes a housing forming an enclosure with a door opening and a door and having a lock for locking the door to the enclosure about the door opening. Also, a second lock for locking the device to the frame disposed within the enclosure having an unlocking portion permitting unlocking of said second lock and is disposed in a manner which provides limited accessibility when the door is open. A key for unlocking the second lock can be inserted into the limited access of the enclosure to open the second lock.

DETAILED DESCRIPTION OF THE PREFERRED EMBODIMENT

Figure 5:
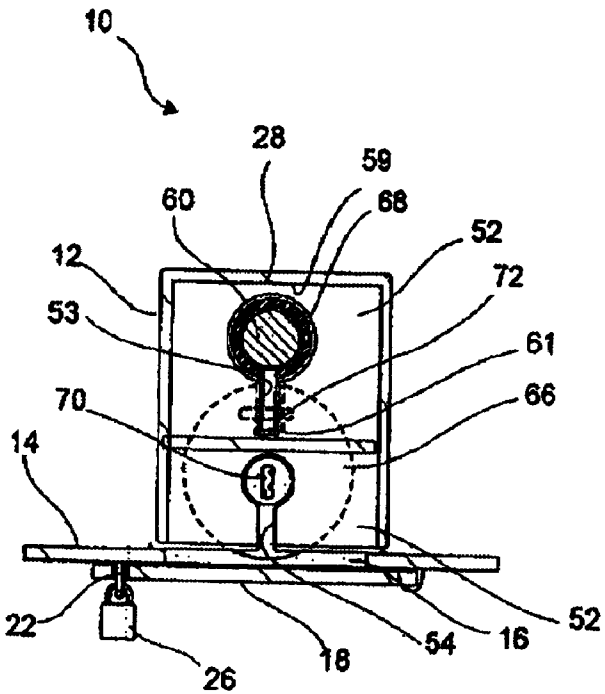
FIG. 5 is a sectional view through line 5—5 of FIG. 2 with a door in the closed position.

The present invention relates to an anti-theft locking device 10. The device 10 includes a housing 12 having at least a front panel 14 having an opening 16 with a door 18 hingedly connected thereto. The door 18 includes a slot 20 to receive therethrough a tongue 22 having an eyelet 24 to permit attachment of a lock 26 as seen in FIG. 5. The tongue 22 is fixed on panel 14, but can be configured to another part of the housing 12 to accomplish the objectives herein.

In the shown embodiment, the housing 12 includes a back panel 28, end panels 30, 32 and side panels 34, 36. Adjacent opening 16, the housing 12 includes an inner cavity 40 which has four side walls 42, 44, 46, 48 and a back wall 50. A portion 52 interconnects walls 44 and 46 and includes a slot 54 of a sufficient size to fit a key through when inserting the key from side 42 toward side 48, for example. The size of the cavil 40 is relatively small to only enable limited key access from one side of the portion 52 to the other side.

End wall 30, side 42, and portion 52 have coaxial aligned open surfaces 58, 56, and 59, respectively, to receive a sliding bar 60 therethrough. An end 62 of the bar 60 has a bore 64 extending therein to receive a radially extending actuating arm pin which can be permanently fixed thereto. The panel 14 has a slot 15 which runs partially longitudinally there along and receives the arm pin 63 therethrough. In this way the arm pin 63 can be used to slide the bar 60 longitudinally a limited distance of travel between locked and unlocked positions.

Figure 2:
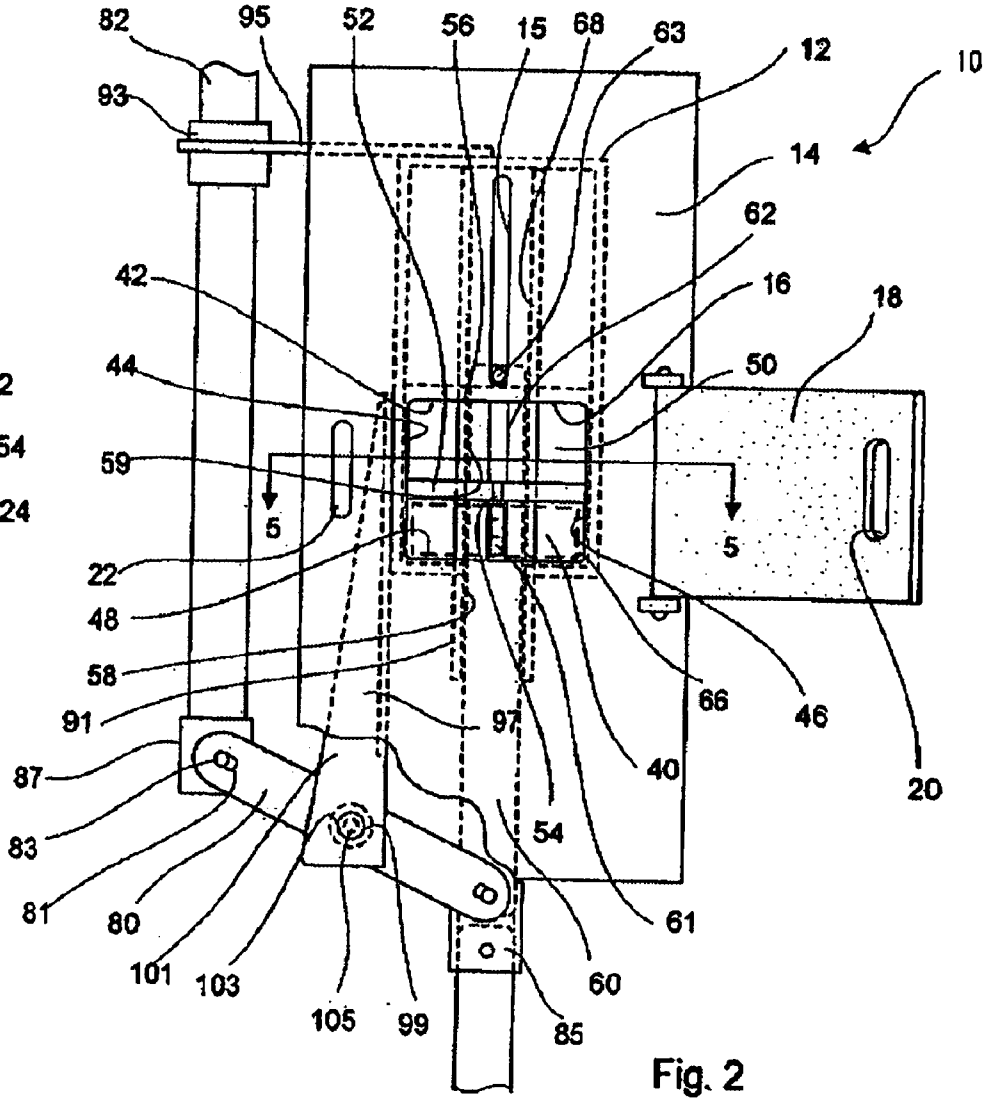
FIG. 2 is a front view of the present invention.
Figure 1:
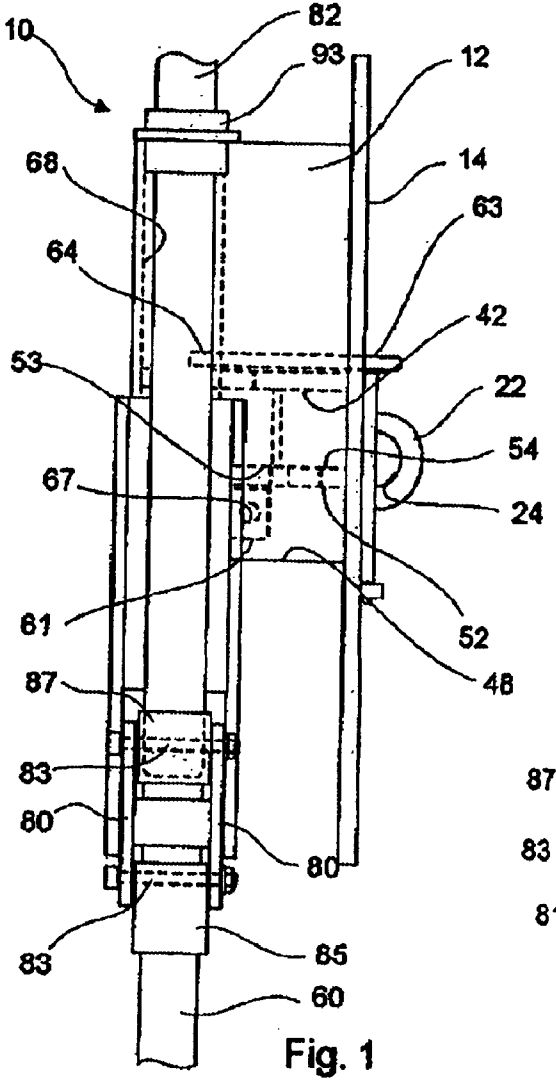
FIG. 1 is a side view of the present invention.
Figure 3:
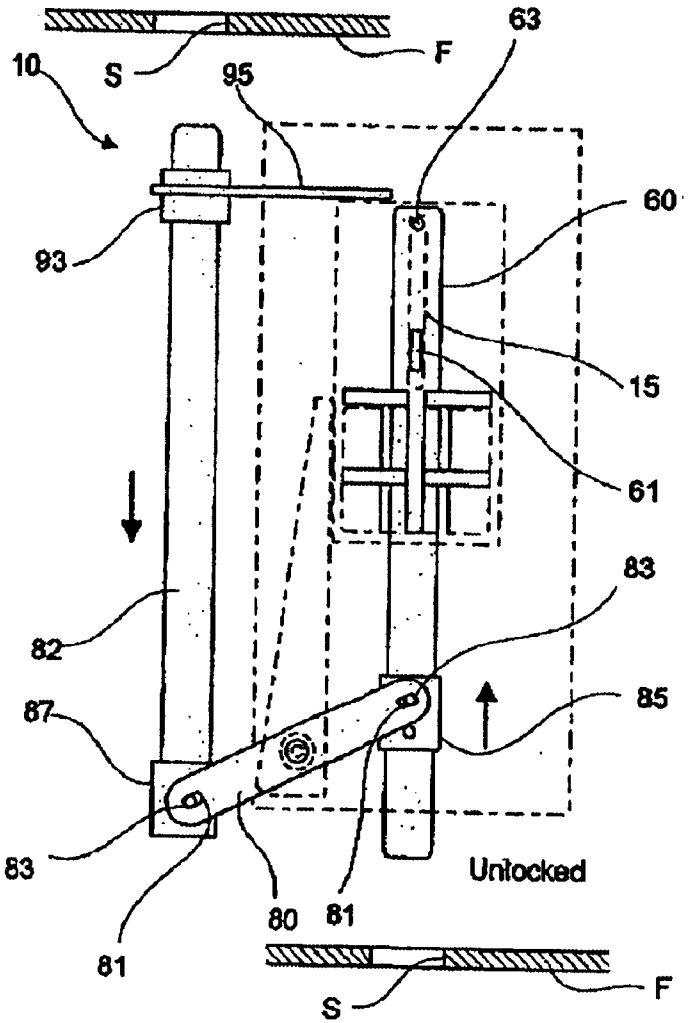
FIG. 3 is a back view of the present invention in an unlocked position.

The bar 60 includes a radially extending tab 61 which includes an eyelet 67 which is designed to receive a locking pin 72 of lock 66. The portion 52 includes a slot 53 through which the tab 61 moves into a lockable position (FIGS. 2, 4) within the cavity 40 and an unlockable position (FIG. 3) wherein the tab 61 is hidden.

The lock 66 is of circumference size to substantially occupy one side of the space in cavity 40 between side 48 and portion 52. The lock 66 is generally C-shaped with an open slot 69 which when positioned correctly within the cavity 40 in alignment with slot 53 of the partition 52 to receive the tab 61 therein. A keyhole portion 70 of the lock 66 is configured to be disposed in alignment with slot 54 of the partition 52. A key (not shown) may be inserted through the slot 54, into keyhole portion 70 and turned which causes the locking pin 72 to extend radially inward the eyelet 67 to lock the bar 60 in place and in turn the bar 82 against movement.

Opening 68 can be designed to receive the end 62 in a guided manner to ensure alignment and ease operation. This can be by a tongue end groove, for example, when end 62 is inserted into the open surface 68.

Figure 4:
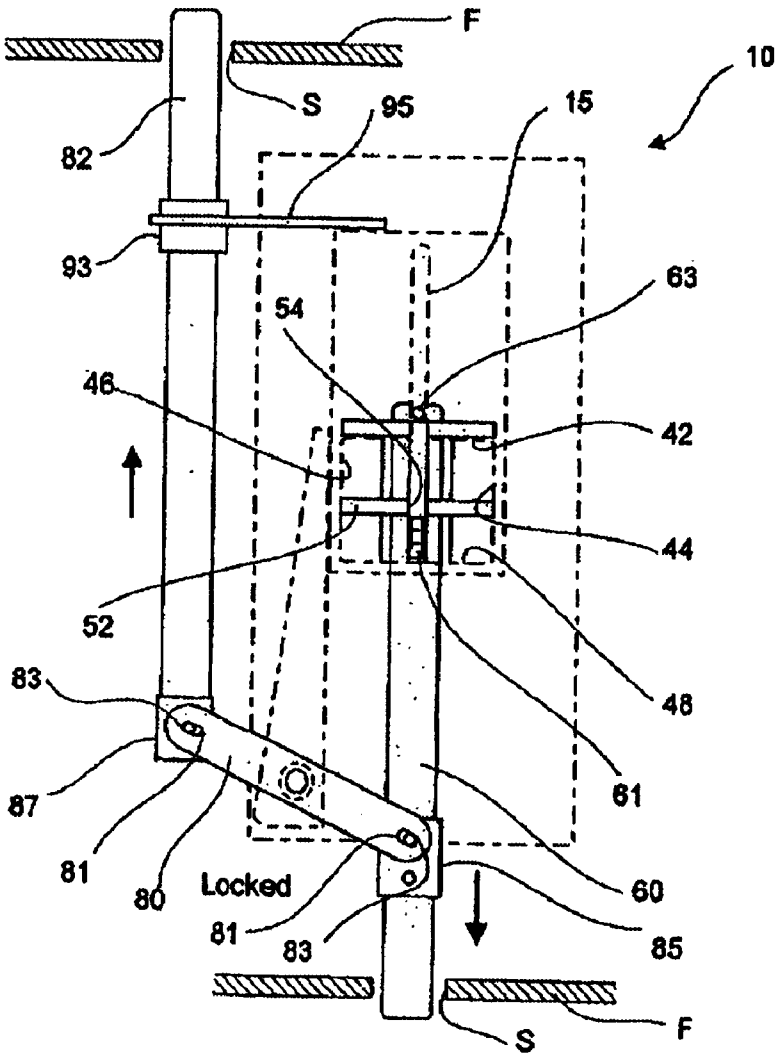
FIG. 4 is a back view of the present invention in a locked position.
Figure 6:
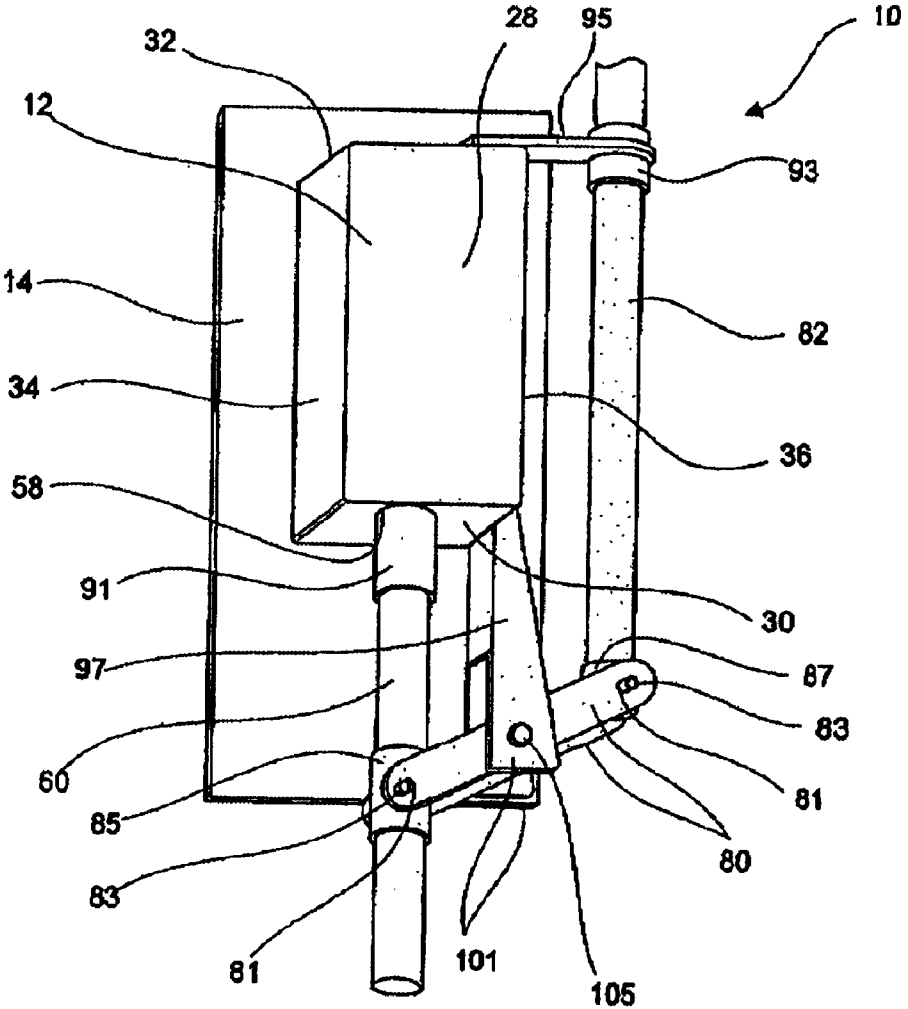
FIG. 6 is a back perspective view of the invention.
Figure 7:
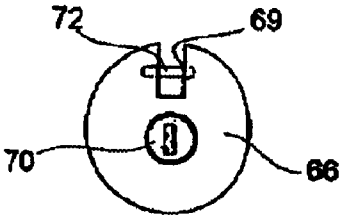
FIG. 7 is a side view of a lock used in the present invention.

As can be seen in FIG. 4, the movement of the bar 60 into the locked position causes bar 82 through the interconnecting bars 80 to extend outwardly in a generally opposite direction to enable the same to move through a frame F. As seen in FIG. 6, for example, the interconnecting bars 80 have slotted surfaces 81 which slidably receive bolts 83 therethrough which extend through and from connector sleeve 85 on bar 60 and end connector sleeve 87 of bar 82. As seen in FIGS. 2–4 and 6, the slotted surfaces 81 are oblong and the bolts 83 limited travel to accommodate the bars 60 and 82 to slide vertically through the sleeves 91 and 93, respectively, without causing bowing, i.e. relative displacement between the bars, as the bars would tend to do if connected in a typical hinge fashion. Thus, this sliding hinge connection provides the means for providing the bars move parallel to one another from locked to unlocked position. The sleeve 91 extends from the end panel 30 and includes the open surface 58 and sleeve 93 is mounted to the top panel 32 by way of a bracket 95. The sleeves 91 and 93 are laterally spaced and parallel aligned position to one another. The bars 80 are also pivotally connected to a bracket 97 which is fixed to side panel 36 (e.g., see FIG. 6) and back of front panel 14. The bracket 97 seen in FIG. 2, for example, includes coaxial open bearing surfaces 99 in arms 101 and bars 80 include an open bearing surface 103 all of which are aligned to receive a bolt 105 therethrough and rotate thereabout. The movement of the bars 60 and 82 remain in a laterally spaced and parallel relation to one another when moved from the locked to the unlocked position. Thus, it should be understood that these bars 60, 82 can thereby move into a locked position within such frame F having a locking bar receiving surface S as seen in FIG. 4 or suitable structure thus locking the device 10. It will be appreciated by those skilled in the art that the structure in which the locking device 10 is to be mounted would have to be adapted with retaining surfaces aligned to removably receive the bars 60 and 82.

The device 10 provides deterrent of theft since there is a double lock mechanism. The first being provided by an outer locking mechanism which when released discloses a second inner locking mechanism which prevents easy access to unlock the device 10. The second locking mechanism is configured to eliminate a drill or other destructive device from accessing the keyhole 70 of the lock 66 in a manner which would remove the pin 72 as seen in FIG. 5.

What is claimed is:

1. A locking device which is configured to mount to a frame of an entry way having at least one locking bar receiving surface therein, which includes:

a housing forming an enclosure with a door opening and a door and having means for locking said door to said enclosure about said door opening;

a first bar which is removably disposable within the locking bar receiving surface, wherein when said first bar is received within the locking bar receiving surface said device is in a locked position and when said first bar is removed from the locking bar receiving surface said device is in an locked position;

a second bar at least partially movably disposed within said enclosure and in a laterally spaced and parallel relation with respect to said first bar said second bar including a sliding actuating arm pin extending forwardly therefrom through a front panel of said housing;

means interconnecting said first bar and said second bar for providing that said bars move parallel to one another to and from said locked position to said unlocked position without causing bowing thereto; and a second means for locking said second bar and in turn said first bar against movement such that said first bar is in said locked position thereby securely locking said device to the frame.

2. The locking device or claim 1, wherein said enclosure includes a partition having an orifice therethrough, said partition disposed transversely adjacent to said door opening and wherein said second locking means is operably disposed on a first side of said partition within said enclosure, wherein said second locking means includes a keyhole and key for permitting locking and unlocking said second locking means wherein said key can access said keyhole through said orifice from a second side of said partition.

3. The locking device of claim 2, wherein said second locking means includes a lock having a locking pin which actuates between an open unlocked position and a closed locked position and said bar includes an eyelet for receiving said pin and when so received forms a locking connection between said second bar and said lock.

4. The locking device of claim 1, wherein said first bar and said second bar are pivotally connected through an interconnecting bar such that movement of said second bar into said locked position causes said first bar to move into said locked position and movement of said second bar into said unlocked position causes said first bar to move into said unlocked position .

5. The locking device of claim 4, wherein said arm pin extends outside of said housing to aid in moving said second bar to and from said locked to said unlocked position.

6. The locking device of claim 1, which includes a first sleeve disposed in a fixed relation with respect to said housing to slidably receive said first bar therethrough and a second sleeve disposed in a fixed relation with respect to said housing to slidably receive said second bar therethrough.

7. The locking device of claim 1, wherein said interconnecting means includes a bolt which slides through slotted surfaces to freely permit said bars to move between said positions.

* * * * *